US005649851A

United States Patent [19]

Boucherie

[11] Patent Number: 5,649,851

[45] Date of Patent: Jul. 22, 1997

[54] DEVICE FOR ROUNDING THE ENDS OF THE FIBRES OF BRUSHES

[75] Inventor: Bart Gerard Boucherie, Izegem, Belgium

[73] Assignee: Firma G.B. Boucherie Naamloze Vennootschap, Izegem, Belgium

[21] Appl. No.: 511,222

[22] Filed: Aug. 4, 1995

[30] Foreign Application Priority Data

Aug. 17, 1994 [BE] Belgium ..... 9400745

[51] Int. Cl.[6] ..... A46D 9/02; B24B 7/02

[52] U.S. Cl. ..... 451/139; 300/17; 451/150; 451/236

[58] Field of Search ..... 300/17; 451/120, 451/124, 139, 150, 151, 152, 153, 154, 236

[56] References Cited

U.S. PATENT DOCUMENTS

| | | | |
|---|---|---|---|
| 2,669,075 | 2/1954 | Dreyfus | 300/17 X |
| 2,700,259 | 1/1955 | Dreyfus | 300/17 X |
| 4,144,675 | 3/1979 | Takahasi et al. | 300/17 X |
| 5,472,263 | 12/1995 | Gerspacher | 300/17 |

FOREIGN PATENT DOCUMENTS

| | | |
|---|---|---|
| 0 019 944 | 12/1980 | European Pat. Off. . |
| 0 054 484 | 6/1982 | European Pat. Off. . |
| 91 07 687.0 | 9/1991 | Germany . |

*Primary Examiner*—Timothy V. Eley
*Attorney, Agent, or Firm*—Bacon & Thomas

[57] ABSTRACT

A device for rounding the ends of the fibres of brushes (1), in particular fibres which are made of synthetic material, contains a first support (5) which can be moved in a direction in relation to a brush (1); a second support (4) which is mounted, rotatable around an axis (10) which is at right angles to this direction, on the first support (5); a first drive assembly (15) to rotate this second support (4); a grinding surface (3) which is mounted in a moveable manner on the second support (4) and against which the fibres are provided; and a second drive arrangement (12) to move this grinding surface (3). The grinding surface (3) is at least part of the jacket of a cylinder (2) whose axis (11) is directed crosswise to the axis (10) around which the second support (4) rotates in relation to the first support (5).

7 Claims, 1 Drawing Sheet

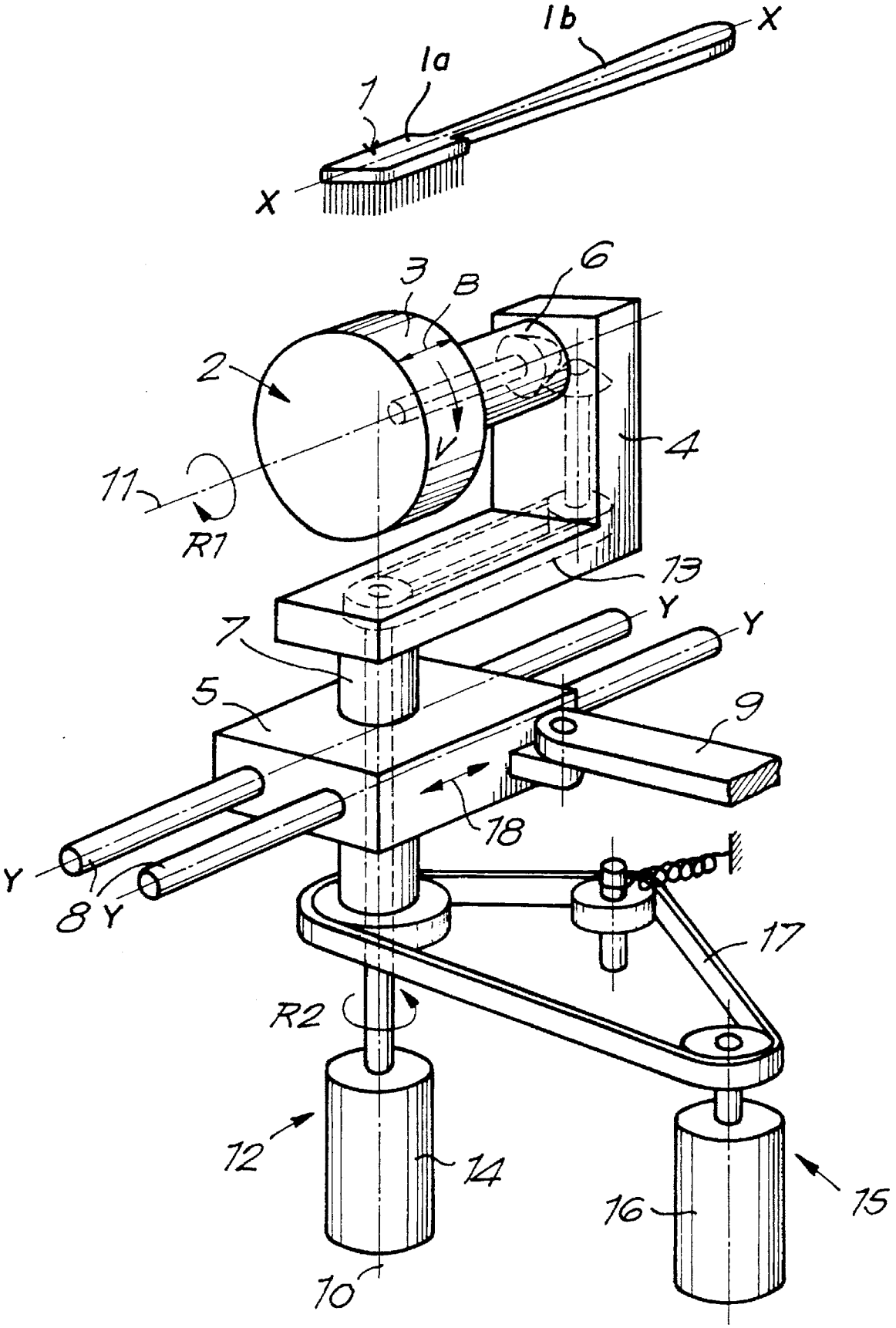
1b
X
1a
1
X
3
B
6
2
V
4
11
R1
13
Y
Y
7
5
9
18
Y
8
Y
17
R2
12
14
16
15
10

DEVICE FOR ROUNDING THE ENDS OF THE FIBRES OF BRUSHES

BACKGROUND OF THE INVENTION

1. Field of the Invention

The invention concerns a device for rounding the ends of the fibres of brushes, in particular fibres which are made of synthetic material, which device contains a first support which can be moved in a direction in relation to a brush; a second support which is mounted, rotatable around an axis which is at right angles to said direction, on the support; means to rotate this second support; a grinding surface which is mounted in a moveable manner on the second support and against which the fibres are provided; and means to move this grinding surface.

2. Discussion of the Prior Art

During the manufacturing of the brushes, after the insertion, the free ends of the brushes are shaved off so as to smooth away the unevennesses which have arisen during the insertion of the fibres. As a result of this shaving, sharp edges are created at the fibre ends, which cannot be tolerated for certain brushes.

This is for example the case for tooth brushes, where the sharp edges could hurt the gums, or for hair brushes, where the sharp edges could hurt the scalp.

EP-A-0 019 944 describes a device for rounding the ends of the fibres of the above-mentioned type. In this device, the grinding surface consists of a disc which is equipped with a suitable abrasive and/or a suitable moulded pattern and which is mounted on the second support in a rotatable manner around a shaft which is parallel to, but eccentric to the axis around which this second support can in turn rotate in relation to the first support. The whole device (first support, disk, second support can be shifted back and forth.

The linear speed of a point of such a disk, during the rotation, is higher as this point is situated further from the axis of rotation. This implies that when a brush is put into contact with the disk, the fibres make contact with points which have different peripheral velocities, so that the fibres are ground and rounded at different grinding speeds. This uneven grinding effect is disadvantageous for the quality of the brush. Moreover, the rotating disc always moves in the same sense, so that also the direction of grinding is always the same. Hence, with such an arrangement, two grinding units, whose discs are driven in the opposite sense, must be provided for proper grinding, which is a costly solution.

In order to remedy these disadvantages, it has already been suggested to replace the disc by a grinding belt running over horizontal rollers, whereby the brushes are put against a topmost flat part of the grinding belt and whereby all points of this grinding surface move at the same speed. In order to change the grinding direction, the entire belt is rotated around a vertical shaft, but the advantage of the equal speed is consequently lost. The belt must be as wide as the length of the brush, since the latter must be able to rest entirely on the grinding surface. Due to the rotation of the belt, the points of the belt will make a combined, total movement which is larger as they are situated further away from the axis of the vertical shaft. Given the large width of the belt, the differences in speed can be significant.

In both these known devices, the entire brush surface, or in the case of a tooth brush the entire surface of the brush head, makes contact with the grinding surface so that, apart from the above-mentioned disadvantages, the different fibres make contact with other points of the grinding surface at the same time, so that even more differences may be created during the grinding process to which these fibres are subjected.

SUMMARY OF THE INVENTION

The invention aims to remedy these disadvantages and to provide a device for rounding the ends of the fibres of brushes which allows for an efficient rounding of the fibres.

This aim is reached according to the invention because the grinding surface is at least part of the jacket of a cylinder whose axis is directed crosswise to the axis around which the second support rotates in relation to the first support.

The contact between the cylindrically bent grinding surface and the almost flat surface of the brush fibres consists of a rolling but contact. The grinding speed and direction of grinding is precisely defined in all points of this contact. By moving the first support in relation to the brush or brush head, the rolling butt contact can be moved, and consequently the fibres of the entire fibre surface can be evenly rounded.

According to a particular embodiment of the invention, the jacket of the cylinder forms a grinding surface over its entire perimeter, and the means to move this grinding surface are means to rotate this cylinder around its axis.

Practically, the axis of the cylinder intersects the axis around which the second support can rotate in relation to the first support. Preferably, the center of the cylinder is situated on the latter axis.

Advantageously, the first support can be moved in relation to a stationary brush, and the device contains a mechanism to move this first support.

BRIEF DESCRIPTION OF THE DRAWING

In order to better explain the characteristics of the invention, the following preferred embodiment of a device for rounding the ends of the fibres of brushes is described as an example only without being limitative in any way, with reference to the accompanying drawing which shows a perspective view of the device.

DETAILED DESCRIPTION OF THE PREFERRED EMBODIMENT

This device is erected opposite a brush 1, for example a tooth brush, whose fibres need to be rounded, and mainly consists of a cylinder 2 whose jacket forms a grinding surface 3, a second support 4 for this cylinder 2 and a first support 5 upon which the second support 4 is mounted.

The brush 1 includes a base 1*a* extending in an imaginary plane that includes axis X—X that extends along a longitudinal direction of elongated handle 1*b* and base 1*a*. The width of the brush extends transversely to the longitudinal direction.

The cylinder 2 which carries out the actual rounding is fixed on a shaft 6 which is freely rotatable with respect second support 4. The second support 4 is mounted on a shaft 7 which is freely rotatable relative to first support 5. The first support 5 forms a carriage which can shift freely back and forth linearly in a predetermined direction 18 over a guide 8 formed by two rods. It will be observed that the linear predetermined direction 18 established by rods 8 is parallel to longitudinal axis X—X of brush 1.

The back and forth movement of the first support 5 takes place in the direction indicated by the arrows 18 along axis Y-4 by means of a suitable mechanism, for example a crank mechanism partially shown at 9. Axis Y—Y extends parallel with axis X—X.

The axis 10 of the shaft 7, i.e. the axis of rotation of the second support 4 in relation to the support 5, is directed at right angles to the above-mentioned direction 18. The axis 11 of the shaft 6 intersects the axis 10 at right angles, whereby the intersection coincides with the center of the cylinder 2.

The device further contains means 12 to rotate the cylinder 2 around the axis 11 at a speed R1. This means 12 can be of a known construction and contains for example a transmission 13 which extends through the second support 4 and the hollow shaft 7 and is connected to a motor 14, as represented.

The device also contains means 15 to rotate the second support 4 around the axis 10 at a speed R2. This means can also be of a known construction and contains for example, as represented, a motor 16 and a belt transmission 17 between this motor 16 and the shaft 7.

The cylinder 2 has an abrasive coating on its jacket, for example of diamond or sapphire grains, or has a rough abrasive surface. The cylinder 2 can also be a grinding stone. The jacket of the cylinder 2 forms the grinding surface 3 and has a width B which is equal to or somewhat larger than the width of the brush 1 or the head of the tooth brush.

The brush 1, whose fibres need to be rounded, is put with its longitudinal direction X—X parallel to the direction of movement of the first support 5 as indicated by the arrows 18 against the grinding surface 3. This can be done by moving the brush 1, but preferably by moving the entire device, for example by means of pressure cylinders, (not shown) against a stationary brush 1. Hereby, the cylinder 2 is preferably situated at the top, as represented, so that the brush 1 makes contact with the top of the jacket of the cylinder 2.

During the operation, the cylinder 2 is continuously driven at a speed R1, by the means 12. The peripheral velocity of the cylinder jacket of the grinding surface 3 is the same everywhere. Thus, all points on a theoretical line which is parallel to the axis 11 at the top of the cylinder jacket, have the same peripheral velocity V, whether they are situated in the middle or on the edges. In all points of this line, the grinding speed and the direction of grinding are precisely defined.

In order to change the direction of grinding, the second support 4 is rotated around the axis 10 in relation to the first support 5 at a speed R2. Thus, a component of velocity is added to the speed of the above-mentioned points if they are not situated in the middle of the line. The component of velocity is bigger as the point is situated further from the axis 11.

However, since the width B of the cylinder jacket is very small, the distance of the points of the above-mentioned line in relation to the axis 11 is also very small, and consequently, the above-mentioned additional component of velocity is also small. As a result, the influence of the thus created differences in speed of the grinding surface in relation to the brush 1 is negligible.

It is clear that the brush 1 only makes contact with the grinding surface 3 according to a rolling butt contact. By means of the linear movement of the support 5 over the guide 8, this rolling but contact can be moved over the entire length of the brush 1.

An even rounding of all fibres of the brush 1 is thus obtained.

It is clear that the invention is by no means limited to the embodiment described as an example and represented in the accompanying drawing; on the contrary, such a device can be made in all shapes and dimensions while still remaining within the scope of the invention.

I claim:

1. A device for rounding the ends of brush fibers comprising:

a brush including brush fibers extending perpendicular from a base having a longitudinal axis (X—X) lying in an imaginary plane;

a first support reciprocally movable relative to said brush along a first axis (Y—Y) extending parallel to said longitudinal axis;

a second support rotatably mounted on said first support for movement therewith and for rotation about a second axis (10) extending perpendicular to said first axis;

a first drive assembly for rotating the second support about said second axis;

a cylinder including a cylindrical peripheral grinding surface rotatably mounted on the second support for rotation about a third axis (11) extending parallel to said first axis and perpendicular to said second axis, said second and third axes intersecting perpendicularly in the central area of the cylinder; and a second drive assembly for rotating said grinding cylinder about said third axis.

2. A device according to claim 1, including a drive assembly for reciprocating the first support along said first axis.

3. A device according to claim 2, wherein said first drive assembly comprises a hollow shaft supported by said first support and rotatable relative to said first support, said shaft being drivingly connected to said second support, said first drive assembly further comprising a first motor and a transmission member drivingly connecting said first motor to said hollow shaft.

4. The device according to claim 3, wherein said second drive assembly includes a plurality of interconnected drive elements, one of said drive elements extending through said hollow shaft and being rotatable relative to said hollow shaft.

5. The device according to claim 4, wherein one of said interconnected drive elements is located on and supported by said second support.

6. The device according to claim 5, wherein one of said drive elements extends along said second axis.

7. A device according to claim 1, wherein said brush and grinding surface have corresponding width dimensions, the width dimension of the brush extending transversely of the base longitudinal axis and the width dimension of the grinding surface extending parallel to said third axis.

* * * * *